US007309553B2

(12) United States Patent
Tomita et al.

(10) Patent No.: US 7,309,553 B2
(45) **Date of Patent: *Dec. 18, 2007**

(54) OILLESS TONER

(75) Inventors: Kunihiko Tomita, Hatano (JP); Naoki Iwata, Niiza (JP)

(73) Assignee: Ricoh Company Limited, Tokyo (JP)

( * ) Notice: Subject to any disclaimer, the term of this patent is extended or adjusted under 35 U.S.C. 154(b) by 28 days.

This patent is subject to a terminal disclaimer.

(21) Appl. No.: 10/200,519

(22) Filed: Jul. 23, 2002

(65) Prior Publication Data

US 2003/0039911 A1 Feb. 27, 2003

(30) Foreign Application Priority Data

Jul. 23, 2001 (JP) ..... 2001-221322
Jul. 23, 2001 (JP) ..... 2001-221370

(51) Int. Cl.
*G03G 9/087* (2006.01)

(52) U.S. Cl. ..... 430/108.4; 430/108.8; 430/109.3

(58) Field of Classification Search ..... 430/108.4, 430/108.8, 109.3
See application file for complete search history.

(56) References Cited

U.S. PATENT DOCUMENTS

| | | | | |
|---|---|---|---|---|
| 4,148,937 | A * | 4/1979 | Kurachi et al. | 427/194 |
| 4,877,704 | A * | 10/1989 | Takagiwa et al. | 430/99 |
| 5,079,123 | A * | 1/1992 | Nanya et al. | 430/108.4 |
| 5,087,677 | A | 2/1992 | Brekner et al. | 526/160 |
| 5,220,383 | A | 6/1993 | Enoki et al. | 118/651 |
| 5,245,391 | A | 9/1993 | Suzuki et al. | 118/651 |
| 5,311,263 | A | 5/1994 | Suzuki et al. | 118/651 |
| 5,339,141 | A | 8/1994 | Suzuki et al. | |
| 5,424,814 | A | 6/1995 | Suzuki et al. | 118/651 |
| 5,450,172 | A | 9/1995 | Suzuki et al. | |
| 5,502,552 | A | 3/1996 | Iwata et al. | 118/647 |
| 5,527,657 | A | 6/1996 | Takeda et al. | 430/903 |
| 5,541,029 | A | 7/1996 | Iwata et al. | 430/45 |
| 5,557,392 | A | 9/1996 | Iwata | |
| 5,565,294 | A * | 10/1996 | Sawai et al. | 430/108.2 |
| 5,809,386 | A | 9/1998 | Iwata | 399/281 |
| 5,812,917 | A | 9/1998 | Iwata et al. | 399/281 |
| 6,210,852 | B1 | 4/2001 | Nakamura | |
| 6,268,099 | B1 * | 7/2001 | Eguchi et al. | 430/108.8 |
| 6,370,350 | B2 | 4/2002 | Tomita | 399/286 |
| 6,370,352 | B1 | 4/2002 | Tomita | 399/328 |
| 6,413,690 | B2 | 7/2002 | Tomita | 430/108.1 |
| 6,492,084 | B2 * | 12/2002 | Tomita | 430/109.3 |
| 6,653,039 | B2 * | 11/2003 | Tomita | 430/109.3 |
| 6,713,221 | B2 * | 3/2004 | Kada et al. | 430/108.4 |
| 2001/0051310 | A1 * | 12/2001 | Tomita | 430/109.3 |
| 2003/0031947 | A1 * | 2/2003 | Tomita | 430/109.3 |

FOREIGN PATENT DOCUMENTS

| | | | |
|---|---|---|---|
| EP | 0 156 464 | B1 | 10/1985 |
| EP | 0 203 799 | A1 | 12/1986 |
| EP | 0 283 164 | A2 | 9/1988 |
| EP | 0 283 164 | A3 | 9/1988 |
| EP | 0 317 262 | A2 | 5/1989 |
| EP | 0 407 870 | A2 | 1/1991 |
| EP | 0 407 870 | A3 | 1/1991 |
| EP | 0 843 223 | | 5/1998 |
| EP | 0 978 766 | | 2/2000 |
| EP | 1 152 297 | | 11/2001 |
| JP | 05-009223 | | 1/1993 |
| JP | 05-339327 | | 12/1993 |
| JP | 06-271628 | | 9/1994 |
| JP | 2000-066438 | | 3/2000 |
| JP | 2000-330323 | * | 11/2000 |
| WO | 98/29783 | | 7/1998 |
| WO | WO 01/19617 | | 3/2001 |
| WO | WO 01/84248 | | 11/2001 |

OTHER PUBLICATIONS

Trademark Elecrionic Search System (TESS) search of the trademark TICONA, printed on Jun. 18, 2004.*
Japanese Patent Office machine-assisted translation of JP 2000-330323 (pub. Nov. 2000).*
U.S. Appl. No. 10/133,754, filed Apr. 29, 2002, pending.
U.S. Appl. No. 09/933,153, filed Aug. 21, 2001, pending.
U.S. Appl. No. 09/843,176, filed Apr. 26, 2001, per client.
U.S. Appl. No. 09/842,156, filed Apr. 26, 2001, pending.
U.S. Appl. No. 09/813,218, filed Mar. 21, 2001, pending.
U.S. Appl. No. 09/778,733, filed Feb. 8, 2001, allowed.
U.S. Appl. No. 09/734,842, filed Dec. 13, 2000, pending.
U.S. Appl. No. 10/424,077, filed Apr. 28, 2003, Suzuki et al.
U.S. Appl. No. 10/247,631, filed Sep. 20, 2002, Tomita et al.
U.S. Appl. No. 10/457,543, filed Jun. 10, 2003, Tomita.
U.S. Appl. No. 10/445,941, filed May 28, 2003, Tomita.
ESP@Cenet Abstract Describing EP. 0407870 (pub Jan. 1991).
U.S. Appl. No. 10/680,091, filed Oct. 8, 2003, Omata et al.
U.S. Appl. No. 10/733,242, filed Dec. 12, 2003, Iwata et al.
U.S. Appl. No. 11/105,427, filed Apr. 14, 2005, Tomita.
U.S. Appl. No. 10/645,614, filed Aug. 22, 2003, Sohmiya et al.

* cited by examiner

*Primary Examiner*—Janis L. Dote
(74) *Attorney, Agent, or Firm*—Oblon, Spivak, McClelland, Maier & Neustadt, P.C.

(57) ABSTRACT

An oilless toner including at least (A) a cyclic olefin resin; (B) a resin having one or more carbon-carbon double bonds therein; and (C) a wax.

12 Claims, 1 Drawing Sheet

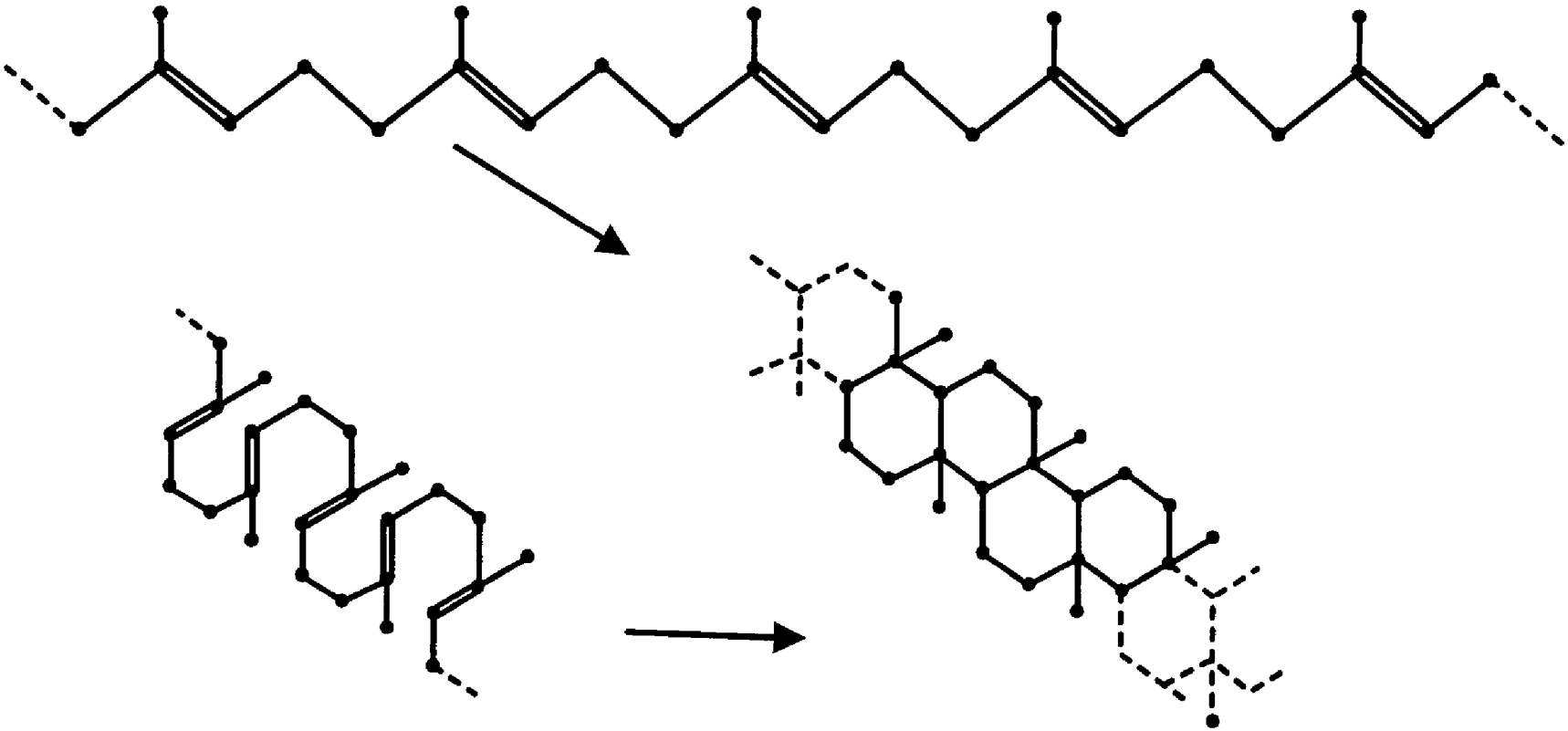

OILLESS TONER

BACKGROUND OF THE INVENTION

1. Field of the Invention

The present invention relates to a toner for electrophotography, and more particularly to a toner widely usable for copiers, printers, facsimiles, color copiers, color laser printers and electrophotographic high-speed printers, etc. using a heating roller fixer.

2. Discussion of the Background

In accordance with rapid technological innovation, copy images having high quality, good fixability and offset resistance in electrophotographic copiers and printers are demanded more than ever.

For example, International Laid-Open Patent Publication No. WO98/29783 discloses using an olefin polymer having a ring structure and high viscosity as a toner binder, and a wax selected from the group consisting of amide waxes, carnauba waxes, higher fatty acids and their esters, higher fatty acid metal soaps, partially-saponified higher fatty acid esters, higher aliphatic alcohols, polyolefin waxes and paraffin waxes for offset resistance. However, this is unpractical because of having a non-offset fixing temperature range of from 30 to 40° C.

Japanese Laid-Open Patent Publication No. 2000-066438 discloses a toner including a combination of a polar wax and a non-polar wax. However, the toner is unsatisfactory in fixing using a teflon roller.

Because of these reasons, a need exists for a toner having improved fixability in high-speed copying as well as at a low temperature and pressure, good transparency and suitability for color copies.

SUMMARY OF THE INVENTION

Accordingly, an object of the present invention is to provide a toner having improved fixability in copying at a high-speed as well as at a low temperature and pressure, good transparency and suitability for color copies.

Briefly this object and other objects of the present invention as hereinafter will become more readily apparent can be attained by an oilless toner including at least a cyclic olefin resin; a wax; and a resin which includes a segment including one or more double bonds, in which a weight ratio of the cyclic olefin resin and the resin is from 100/3 to 5/100; the resin is cyclized polyisoprene or cyclized polybutadiene; a weight ratio of the resin and the wax is from 30/100 to 100/3; the wax has a penetration not greater than 40; the wax is a ester wax and an acid wax, such as carnauba wax, candelilla wax, montan wax, rice wax, esparto wax and castor wax; the wax may optionally include paraffin waxes, olefin waxes, microcrystalline waxes and/or their oxidized waxes in an amount of from 1 to 20% based on total weight of the wax; and the wax has a melt viscosity of from 1 to 10,000,000 c poise at 150° C.

These and other objects, features and advantages of the present invention will become apparent upon consideration of the following description of the preferred embodiments of the present invention taken in conjunction with the accompanying drawing.

BRIEF DESCRIPTION OF THE DRAWING

Various other objects, features and attendant advantages of the present invention will be more fully appreciated as the same becomes better understood from the detailed description when considered in connection with the accompanying drawing in which like reference characters designate like corresponding parts throughout and wherein:

FIGURE is a schematic view illustrating an embodiment of a reaction of the cyclized rubber (resinoid plastic substance) of the present invention.

DETAILED DESCRIPTION OF THE INVENTION

Generally, the present invention provides a toner having improved fixability in copying at a high-speed as well as at a low temperature and pressure, good transparency and suitability for color copies. The toner uses properties of an olefin polymer having a ring structure. By using a ring olefin copolymer prepared by monomers mixed at a specific ratio, having a specific molecular weight and by optionally mixing hybrid polymers and additives, the softening point, melting point and dielectric property of the resultant toner can be controlled, and thereby the non-offset fixing temperature range of the toner can be expanded. In addition, the high-speed fixability and low-temperature/low-pressure fixability can be also improved.

Hereinafter, investigation results of the prior art and the present invention will be explained in detail.

As a cyclic olefin which is a component of the toner of the present invention, a cyclic olefin from Ticona GmbH is used as an example. However, the cyclic olefin for use in the toner of the present invention is not limited thereto. Any cyclic olefins in a category of conventional petroleum resins can be used in the present invention.

In fact, the cyclic olefin used in the experiments is disclosed in Japanese Laid-Open Patent Publication No. 2000-066438.

The olefin polymer for use as a binder resin of the toner of the present invention is formed from an α-olefin (a non-cyclic olefin in a broad definition) having 2 to 12 carbon atoms, and preferably 2 to 6 carbon atoms such as ethylene, propylene and butylene (i.e., a lower alkene); and a cyclic and/or polycyclic compound (cyclic (cyclo) olefin) having 3 to 17 carbon atoms, and preferably from 5 to 12 carbon atoms such as norbornene, tetracyclododecene, dicyclopentadiene and cyclohexene, and preferably norbornene or tetracyclododecen. The olefin polymer is a transparent and colorless copolymer having a high optical transmittance.

The olefin polymer having a ring structure is a polymer which can be obtained by a polymerization method using a catalyst such as a metallocene catalyst, a Ziegler catalyst, a catalyst for metathese polymerization, i.e., double bond opening and a catalyst for ring opening polymerization reaction. Synthesis examples of an olefin polymer having such a structure are disclosed in Japanese Laid-Open Patent Publications Nos. 5-339327, 5-9223, 6-271628, and European Laid-Open Patent Publications Nos. 203799(A), 407870(A), 283164(A) and 156464(A).

According to these patent publications, one or more monomer of the above-mentioned cyclic olefin and optionally one of the above-mentioned non-cyclic olefin monomer are polymerized at a temperature of from 78 to 150° C., and preferably from 20 to 80° C. and a pressure of from 0.01 to 64 bar with a co-catalyst such as aluminoxane and a catalyst formed from one of metallocene such as zirconium or hafnium to obtain the olefin polymer having a ring structure. European Laid-Open Patent Publication No. 317262(A) discloses other suitable polymers such as hydrogenated polymers and copolymers formed from styrene and dicyclopentadiene.

When a metallocene catalyst is dissolved in inactive carbon hydride such as aliphatic or aromatic carbon hydride, the metallocene catalyst becomes active, e.g., when a metallocene catalyst is dissolved in toluene, a preliminary activation and reaction are performed in the solvent. Important properties of the olefin polymer having a ring structure are a softening point, a melting point, a viscosity, a dielectric property, a non-offset fixing temperature range and transparency. These can be advantageously controlled by adjusting monomer/comonomer ratio, i.e., molar-ratio of monomers in a copolymer, molecular weight and molecular weight distribution, and by optionally mixing hybrid polymers and additives.

In addition, a mixing molar-ratio of a non-cyclic olefin and a cyclic olefin can be widely changed according to a purpose of an olefin polymer having a ring structure, and preferably from 50/1 to 1/50, and more preferably from 20/1 to 1/20.

For example, when two compounds, i.e., ethylene as a non-cyclic olefin and norbornene as a cyclic olefin, are mixed and reacted to form a copolymer, glass transition (Tg) of the olefin polymer having a ring structure as the reaction product is largely dependent on the mixing ratio of the ethylene and the norbornene. When the content of the norbornene is increased, Tg also tends to increase, e.g., when the content of the norbornene is about 60% by weight, Tg is from about 60 to 70° C. Properties such as number-average molecular weight are adjusted as known from literature.

A resin actually used as an example in the present invention is a transparent and colorless olefin polymer having a ring structure and a high optical transmittance, and is characterized by including the following (a) a polymer or a polymer fraction having a low viscosity and (b) a polymer or a polymer fraction having a high viscosity. Namely, the olefin polymer may be a mixture of the polymer (a) and the polymer (b). The olefin polymer may include a polymer fraction having a molecular-weight distribution with one peak and a number-average molecular weight less than 7,500 and a polymer fraction having a molecular-weight distribution with one peak and a number-average molecular weight not less than 7,500. Alternatively, the olefin polymer may include a polymer fraction having a molecular-weight distribution with two or more peaks and a number-average molecular weight less than 7,500 and a polymer fraction having a molecular-weight distribution with two or more peaks other than the peaks and a number-average molecular weight not less than 7,500.

When the olefin polymer having a ring structure includes (a) a polymer or a polymer fraction having a low viscosity (molecular weight) and (b) a polymer or a polymer fraction having a high viscosity (molecular weight), the non-offset fixing temperature range is expanded up and down, and thereby the fixability of the resultant toner in copying at a high-speed as well as at a low temperature and pressure can be improved.

The polymer or polymer fraction (a) (hereinafter referred to as a component a) has a number-average molecular gweight less than 7,500, preferably from 1,000 to less than 7,500, and more preferably from 2,000 to less than 7,500, which is measured by GPC (gel permeation chromatography) at a polyethylene conversion; weight-average molecular weight less than 15,000, preferably from 1,000 to less than 15,000, and more preferably from 4,000 to less than 15,000; limit viscosity (i.v.; an intrinsic viscosity of the polymer when uniformly dissolved in 100 ml of decalin at 135° C.) less than 0.25 dug; and Tg preferably less than 70° C. In another embodiment, the cyclic olefin resin is formed from (a) at least 50% by weight of a polymer component having a number average molecular weight less than 7,500 and (b) less than 50% by weight of a polymer component having a number average molecular weight not less than 7,500.

The polymer or polymer fraction (b) (hereinafter referred to as a component b) has a number-average molecular weight not less than 7,500, preferably from 7,500 to 50,000; weight-average molecular weight not less than 15,000, preferably from greater than 15,000 to 500,000; limit viscosity (i.e., i.v.) not less than 0.25 dl/g.

Further, the component b is characterized by having a content less than 50%, and preferably from 5 to 35% by weight. The component b imparts a structural viscosity to the resultant toner, resulting in improvements of offset resistance and adherence thereof to receiving materials such as papers and films. When the content is not less than 50% by weight, uniform kneadability extremely deteriorates and the resultant toner has poor performance. Namely, a high quality, i.e., a clear image having high fixability and good heat response cannot be easily produced, and mechanical pulverizability deteriorates and the resultant toner is technologically difficult to have a desired particle diameter.

In addition, when the olefin polymer having a ring structure includes a mixture of various components having different number-average molecular weight, the polymer or the polymer fraction means each polymer component before mixture. In other cases, the polymer or the polymer fraction segments means polymer segments obtained by fractionating the final synthesized product by suitable means such as GPC. In addition, when these polymer fractions are monodispersion or close to monodispersion, the number-average molecular weight (Mn) of 7,500 is nearly equal to weight-average molecular weight (Mw) of 15,000.

The low-viscosity component a included in the olefin polymer having a ring structure contributes to expand the non-offset fixing temperature range down, and to the contrary, the high-viscosity component b contributes to expand the non-offset fixing temperature range up. The high-viscosity component b preferably has a number-average molecular weight not less than 20,000 in order to expand the non-offset fixing temperature range up more effectively. The components a and b included in the olefin polymer preferably have a content not less than 0.5, and more preferably from 5 to 100 parts by weight, respectively per 100 parts by weight of the binder resin. When both are less than 0.5parts by weight, a practical wide non-offset fixing temperature range is difficult to obtain.

Since the olefin polymer having a ring structure has the number-average molecular weight (Mn), weight-average molecular weight (Mw) and limit viscosity (i.v.) as mentioned above, Mw/Mn representing dispersion of the molecular weight distribution is small, i.e., from 1 to 2.5. Therefore, the polymer is monodispersion or close to monodispersion and has a quick heat response and the resultant toner has high fixability, and is fixable at a low temperature and pressure. At the same time, the toner has good preservability, toner-spent resistance and electrical stability representing uniformity of the charge quantity distribution and charged and discharged efficiency. In particular, when the polymer or polymer fraction having a low viscosity is monodispersion or close to monodispersion, the resultant toner instantly melts and coagulates, i.e., the toner has good heat response.

In addition, since the olefin polymer having a ring structure is transparent and has a high optical transmittance, e.g., after an azo pigment "Permanent Rubine F6B" (from Clariant) is included therein and sufficiently kneaded, a sheet formed of the mixture by a pressing machine also has good transparency, and therefore the polymer can be also used for a color toner. In addition, the olefin polymer has quite a low melting point when measured by a DSC (differential scanning calorimetry) method, and it can be expected that energy consumed by fixing the toner is largely economized.

When the olefin polymer having a ring structure is modified, the following improvements can be made for the resultant toner. The compatibility of the olefin polymer with the other resins and dispersibility of a pigment in the toner can be improved, and adherence and fixability of the toner onto receiving materials such as papers and films can be improved when a carboxyl group is brought into the olefin polymer having a ring structure.

As a method of bringing a carboxyl group into the olefin polymer, a two-step method preparing an olefin polymer having a ring structure first and then bringing a carboxyl group into the olefin polymer is advantageous. There are at least two methods to bring a carboxyl group into the olefin polymer. One is a melting air oxidation method oxidizing an alkyl group such as a methyl group at the end of the polymer to form a carboxyl group. However, it is difficult to obtain many carboxyl groups by this method when the olefin polymer having a ring structure is synthesized by a metallocene catalyst because of having few branches.

Specifically, maleic anhydride, acrylic acid or methacrylic acid is graft-polymerized with an olefin polymer having a ring structure so as to have a weight graft ratio of preferably from 1 to 5%, and more preferably from 3 to 5% by weight, using peroxide such as t-butanolperoxide as a starter to bring in a carboxyl group. When the weight graft ratio is less than 1% by weight, the above-mentioned effect of improvement of the compatibility is not sufficiently exerted. When greater than 5% by weight, an intermolecular cross-linkage occurs and the molecular weight increases, and the resultant toner has unpractical kneadability and pulverizability. In addition, the toner extremely becomes yellowish and devitrified, which is unsuitable for a color toner requiring colorless and transparency. Further, similar improvements can be made by bringing in a hydroxyl group or an amino group by a known method.

In order to improve fixability of a toner, a crosslinked structure can be brought in the olefin polymer having a ring structure. One of the methods bringing in the crosslinked structure is tercopolymerizing a dienemonomers such as cyclopentadiene, cyclohexadiene, norbornadiene, tetracyclododecadiene and butadiene together with non-cyclic olefin and cyclic olefin when polymerizing the olefin polymer. By this method, the olefin polymer has an active end without a cross-linker, and has a crosslinked structure by a known chemical reaction such as oxidization and epoxidation or by including a cross-linker. Another method is including a metal such as zinc, copper and calcium in the above-mentioned olefin polymer having a ring structure in which a carboxyl group is brought in; and mixing and melting the mixture with a screw to disperse the metal in the polymer as fine particles to form an ionomer.

As the ionomer technology itself, e.g., U.S. Pat. No. 4,693,941 discloses an ethylene terpolymer including a carboxyl group capable of becoming a form of a diatomic metallic salt by being partially or completely neutralized for the purpose of obtaining toughness. In addition, Japanese Laid-Open Publication No. 6-500348 discloses a polyester resin former including an unsaturated carboxylic-acid ionomer for the same purpose, in which 20 to 80% of its carboxylate groups are neutralized by zinc, cobalt, nickel, aluminium or copper (II).

Other resin components besides the above-mentioned olefin polymer having a ring structure can be included in the binder resin. The other components forming a binder resin are as follows:

a mixture or a hybrid polymer selected from one or more of polyester resins such as poly (bisphenol-A)-terephthalate; epoxy resins; olefin resins such as ethylene-propylene copolymers besides the above-mentioned olefin polymer; vinyl acetate resins such as vinyl acetate copolymers; and acrylic resins such as styrene-acrylic resins.

The content of the other resins used together with the olefin polymer having a ring structure in the binder resin is 0 to 99, preferably from 10 to 80, and more preferably from 10 to 50 parts by weight per 100 parts by weight of the binder resin. When the content of the olefin polymer having a ring structure is less than 1 part by weight, high quality images are difficult to produce.

When a resin formed on the basis of such an idea and a properly selected wax are used, a good toner having good offset resistance can be obtained. Therefore, when the thus prepared cyclic olefin resin is used to form a toner, in order to realize the offset resistance against the fixing roller, a wax having a melting point of from 60 to 80° C. is mixed therein to form an oilless toner. However, in practice, when waxes having comparatively a high polarity, such as carnauba, fatty acid amide and polyethylene oxide are mixed with the cyclic olefin, the viscosity is extremely deteriorated because the cyclic olefin is dissolved very easily with these waxes, and an effective elasticity cannot be obtained. In addition, even when low polarity waxes such as paraffin waxes and polymerized olefin waxes are used, the viscosity is further deteriorated and an effective elasticity cannot be obtained, either. Further, even when these high and low polarity waxes are used by mixture, the result is same. What is worse, when these waxes are included, the viscosity of the toner decreases so much that not only the effective elasticity cannot be obtained but also the toner has adherence and tends to adhere to the fixing roller. A similar phenomenon occurs not only when the waxes are included but also when a charge controlling agent is included, which is the largest barrier when the cyclic olefin resin is used.

Even such a toner can narrowly escape from offset when a roller coated with a silicone oil or a silicone roller is used. However, cost of a system having such a roller coated with a silicone oil or a silicone roller is against users' interests.

As a result of keen studies of the present inventors, it is found that such extreme viscosity deterioration and occurrence of adherence can be prevented when a resin having a segment including a double bond is included in a toner.

A hypothesis of this phenomenon is as follows. A resin having a double bond, used in the experiment is cyclized polyisoprene and the cyclized polyisoprene is completely dissolved by a wax.

However, typically, polyisoprene can disperse a wax but cannot be dissolved thereby.

Therefore, it is thought that when polyisoprene is partially cyclized, the cyclized part thereof has good affinity with the wax and the cyclized polyisoprene is completely dissolved by the wax.

However, from a molecular macroscopic point of view, it can be said that the cyclized polyisoprene is no doubt dissolved by the wax; but from a molecular microscopic point of view, the cyclized portion has a complete affinity with the wax but it cannot be said that the isoprene portion has good affinity with the singe bonding wax because of having a double bond.

This is different from the cyclic olefin and thought to be a reason why there is no extreme viscosity deterioration and occurrence of adherence.

Therefore, when a resin having a segment including a double bond and a cyclic olefin resin are mixed, the extreme viscosity deterioration and adherence can be prevented.

When a mixing ratio (C/R) of the cyclic olefin resin (C) to the resin having a segment including a double bond (R) is from 100/3 to 5/100, preferably from 100/5 to 10/100, more preferably from 100/10 to 20/100, and even more preferably from 100/20 to 30/100, an oilless toner having the above-mentioned performance can be obtained.

In addition, a composition ratio between the resin and the wax is 30/100 to 100/3, preferably from 50/100 to 100/4, more preferably from 100/100 to 100/6, and even more preferably from 100/50 to 100/10.

In the present invention, the harder the wax, the better. In addition, the wax has a penetration not greater than 40, preferably not greater than 20, and more preferably not greater than 15.

A toner including a large amount of wax tends to have poor fluidity. However, when paraffin, polymerized olefin and microcrystalline wax are used together, smoothness among toner particles is improved. One to 20% by weight of these waxes can improve smoothness among toner particles without exerting a bad influence on the wax and the toner.

In order to exert performance of the oilless toner of the present invention, the wax has to have a viscosity of from 1 to 10,000,000 c poise. The toner tends to have incomplete releasability when the viscosity is out of this range.

As the above-mentioned resin having a double bond, e.g., cyclized polyisoprene and cyclized polybutadiene can be used, but not limited thereto.

An example of methods of producing such a resin (a cyclized product) is as follows:

By Fisher's method, a rubber in which 5% by weight of a strong sulfuric acid has been kneaded is heated for 15 hrs at 130° C. to form a cyclized rubber. Besides this method, there are methods using organic sulfonic acids; tin chloride; iron chloride; non-metallic halogenated compounds and halogenated primary and secondary stannic acids, etc. as a cyclizer to form various resinoid plastic substances.

As shown in the FIGURE, the cyclized rubber (resinoid plastic substance) is isomerized by an oxidant, and the specific gravity increases and the degree of unsaturation decreases to form a substance having quite a different nature. The cyclized rubber of the present invention can form a resin having a segment including a double bond by such a method.

In addition, polydiene resins such as homopolymers and copolymers obtained from diene monomers may be used. Specific examples of the polydiene resins include trans-1,4-poly-1,3-butadiene, cis-2-tertialbutyl-1,4-poly-1,3-butadiene, trans-1-methoxy-1,4-poly-1,3-butadiene, transchloroprene, trans-1,4-polyisoprene, isotactic-trans-1,4-poly-1,3-pentadiene, isotactic-trans-1,4-poly-1,3-heptadiene, isotactic-trans-6-methyl-1,4-poly-1,3-heptadiene, isotactic-trans-1,4-poly-1,3-hexadiene, isotactic-trans-5-methyl-1,4-poly-1,3-hexadiene, trans-erythrose-isotactic-2,5-poly-2,4-hexadiene, isotactic-trans-1,4-poly-1,3-octadiene and copolymers obtained from monomers of these polymers. The polydiene resins are not limited thereto and these can be used alone or in combination.

A sub-resin may be included in the toner of the present invention. Specific examples of the binder resins (sub-resins) include styrene and its substituted polymers such as polystyrene, poly-p-chlorostyrene and polyvinyltoluene; styrene copolymers such as styrene-p-chlorostyrene copolymers, styrene-propylene copolymers, styrene-vinyltoluene copolymers, styrene-vinylnaphthalene copolymers, styrene-methylacrylate copolymers, styrene-ethylacrylate copolymers, styrene-butylacrylate copolymers, styrene-octylacrylate copolymers, styrene-methylmethacrylate copolymers, styrene-ethylmethacrylate copolymers, styrene-butylmethacrylate copolymers, styrene-α -methylchloromethacrylate copolymers, styrene-acrylonitrile copolymers, styrene-vinyl methyl ketone copolymers, styrene-butadiene copolymers, styrene-isoprene copolymers, styrene-acrylonitrile-indene copolymers, styrene-maleate copolymers and styrene-ester maleate copolymers; polymethylmethacrylate; polybutylmethacrylate; polyvinylchloride; polyvinylacetate; polyester; polyurethane; polyamide; epoxy resins; polyvinylbutyral; polyacrylic resins; rosin; modified rosin; terpene resins; aliphatic or aliphatic hydrocarbon resins; aromatic petroleum resins; and chlorinated paraffin, etc. These resins can be used alone or in combination and the binder resin used for the toner of the present invention is not limited thereto. Carbon black and a color pigment as well as a charge controlling agent can be optionally mixed with these resins.

In addition, an additive such as silica, titanium and strontium may be included in the resins after pulverized to improve fluidity of the resultant toner.

Having generally described this invention, further understanding can be obtained by reference to certain specific examples which are provided herein for the purpose of illustration only and are not intended to be limiting. In the descriptions in the following examples, the numbers represent weight ratios in parts, unless otherwise specified.

EXAMPLES

Example 1

After the following materials were kneaded by a two-roll mill for 1 hr, the mixture was pulverized and classified to perform a fixing test with a teflon roller.

| | |
|---|---|
| Cyclic olefin resin | 60 |
| Cyclized polyisoprene | 25 |
| Carnauba | 15 |
| Carbon black | 10 |
| Charge controlling agent (CCA) | 1 |

As a result, the toner was fixed without hot offset until the roller temperature became 220° C.

Example 2

After the following materials were kneaded by a two-roll mill for 1 hr, the mixture was pulverized and classified to perform a fixing test with a teflon roller.

| | |
|---|---|
| Cyclic olefin resin | 55 |
| Cyclized polybutadiene | 27 |
| Montanic acid ester | 18 |

-continued

| | |
|---|---|
| Carbon black | 12 |
| CCA | 2 |

As a result, the toner was fixed without hot offset until the roller temperature became 220° C.

Example 3

After the following materials were kneaded by a two-roll mill for 1 hr, the mixture was pulverized and classified to perform a fixing test with a teflon roller.

| | |
|---|---|
| Cyclic olefin resin | 65 |
| Trans-1,4-polyisoprene | 25 |
| Polymerized olefin wax | 4 |
| Carnauba | 6 |
| Carbon black | 13 |
| CCA | 2 |

As a result, the toner was fixed without hot offset until the roller temperature became 220° C.

In addition, compared with the other toners, the fluidity was improved and smooth images having few toner dusts were produced.

Example 4

After the following materials were kneaded by a two-roll mill for 1 hr, the mixture was pulverized and classified to perform a fixing test with a teflon roller.

| | |
|---|---|
| Cyclic olefin resin | 55 |
| Cyclized polyisoprene | 20 |
| Polystyrene | 10 |
| Carnauba | 15 |
| Carbon black | 10 |
| CCA | 1 |

As a result, the toner was fixed without hot offset until the roller temperature became 220° C.

Example 5

After the following materials were kneaded by a two-roll mill for 1 hr, the mixture was pulverized and classified to perform a fixing test with a teflon roller.

| | |
|---|---|
| Cyclic olefin resin | 55 |
| Cyclized polyisoprene | 20 |
| Polyester | 10 |
| Carnauba | 15 |
| Carbon black | 10 |
| CCA | 2 |

As a result, the toner was fixed without hot offset until the roller temperature became 220° C.

Example 6

After the following materials were kneaded by a two-roll mill for 1 hr, the mixture was pulverized and classified to perform a fixing test with a teflon roller.

| | |
|---|---|
| Cyclic olefin resin | 55 |
| Cyclized polybutadiene | 20 |
| Ester polyacrylate resin | 10 |
| Carnauba | 15 |
| Carbon black | 10 |
| CCA | 1 |

As a result, the toner was fixed without hot offset until the roller temperature became 220° C.

Comparative Example 1

When the following materials were kneaded by a two-roll mill for 1 hr, melted viscosity of the mixture extremely deteriorated and adherence thereof was so serious that the mixture adhered to a knife and a cooling roller of the two-roll mill, which largely disturbed the kneading operation.

| | |
|---|---|
| Cyclic olefin resin | 90 |
| Carnauba | 10 |
| Carbon black | 10 |
| CCA | 1 |

The mixture was pulverized and classified with difficulty to perform a fixing test with a teflon roller.

As a result, not only hot offset occurred at a temperature of from 140 to 220° C. but also the toner easily wrapped the fixing roller.

This document claims priority and contains subject matter related to Japanese Patent Applications Nos. 2001-221322 and 2001-221370, both filed on Jul. 23, 2001, incorporated herein by reference.

Having now fully described the invention, it will be apparent to one of ordinary skill in the art that many changes and modifications can be made thereto without departing from the spirit and scope of the invention as set forth therein.

What is claimed as new and desired to be secured by Letters Patent of the United States is:

1. A toner comprising:

A) a cyclic olefin resin;

B) a resin having one or more carbon-carbon double bonds contained therein; and

C) a wax having a melt viscosity of from 1 to 10,000,000 c poise at 150° C.;

wherein a weight ratio (B/C) of the resin (B) and the wax (C) is from 30/100 to 100/3;

wherein the resin B) is cyclized polyisoprene or cyclized polybutadiene.

2. The toner of claim 1, wherein a weight ratio (A/B) of the cyclic olefin resin (A) and the resin (B) is from 100/3 to 5/100.

3. The toner of claim 1, wherein the wax comprises a wax selected from the group consisting of ester and acid waxes of carnauba, candelilla, montan, rice, esparto and castor.

4. The toner of claim 1, wherein the wax comprises a second wax selected from the group consisting of paraffin waxes, oxidized paraffin waxes, olefin waxes, oxidized olefin waxes, microcrystalline waxes and oxidized microcrystalline waxes in an amount of from 1 to 20% based on total weight of the wax.

5. The toner of claim 1, wherein the cyclic olefin resin is formed from (i) an a-olefin having from 2 to 12 carbon atoms and (ii) either or both of a cyclic or polycyclic olefin compound having from 3 to 17 carbon atoms.

6. The toner of claim 5, wherein component (ii) is either or both of a cyclic or polycyclic olefin compound having from 5 to 12 carbon atoms.

7. The toner of claim 5, wherein component (i) has from 2 to 6 carbon atoms.

8. The toner of claim 5, wherein component (i) is a member selected from the group consisting of ethylene, propylene and butylenes.

9. The toner of claim 5, wherein component (ii) is one or more members selected from the group consisting of norbornene, tetracyclododecene, dicyclopentadiene and cyclohexene.

10. The toner of claim 9, wherein component (ii) is one or more members selected from the group consisting of norbornene and tetracyclododecene.

11. The toner of claim 5, wherein components (i) and (ii) are present in a molar ratio of from 50:1 to 1:50.

12. The toner of claim 11, wherein components (i) and (ii) are present in a molar ratio of from 20:1 to 1:20.

* * * * *